US009487907B2

(12) United States Patent
Hapke et al.

(10) Patent No.: US 9,487,907 B2
(45) Date of Patent: Nov. 8, 2016

(54) APPLIANCE LOCK WITH MECHANICAL DOOR SENSOR

(75) Inventors: Kenyon A. Hapke, Libertyville, IL (US); Jonathan H. Olson, Sussex, WI (US); Michael S. Osvatic, Waukesha, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 1050 days.

(21) Appl. No.: 13/395,159

(22) PCT Filed: Sep. 9, 2010

(86) PCT No.: PCT/US2010/048250

§ 371 (c)(1),
(2), (4) Date: Mar. 9, 2012

(87) PCT Pub. No.: WO2011/031845

PCT Pub. Date: Mar. 17, 2011

(65) Prior Publication Data

US 2012/0175894 A1 Jul. 12, 2012

Related U.S. Application Data

(60) Provisional application No. 61/241,285, filed on Sep. 10, 2009.

(51) Int. Cl.
*E05C 1/06* (2006.01)
*D06F 39/14* (2006.01)
(Continued)

(52) U.S. Cl.
CPC ..... *D06F 39/14* (2013.01); *D06F 37/42* (2013.01); *E05B 47/0001* (2013.01); *Y10S 292/69* (2013.01); *Y10T 29/49169* (2015.01); *Y10T 292/1021* (2015.04)

(58) Field of Classification Search
CPC ..... E05B 61/00; E05B 47/0001; E05B 47/0002; D06F 37/42; D06F 39/14; Y10T 29/49169; Y10T 292/1021; F24C 15/022; F24C 15/02; F24C 15/028; F24C 3/124; F24C 3/12; F24C 3/122; F24C 3/126; A21B 1/00; A21B 3/02; A47L 15/4259; A47L 15/06; A47L 15/0081; A47L 15/4297; A47L 15/0002; Y10S 292/69
USPC ..... 292/144, 201, 1, DIG. 69, DIG. 66; 126/197, 192; 134/18, 57 DL, 58 DL
See application file for complete search history.

(56) References Cited

U.S. PATENT DOCUMENTS 3,205,031 A * 9/1965 McMillan ..... 200/61.67
3,638,457 A * 2/1972 Filipak ..... 68/12.26
(Continued)

FOREIGN PATENT DOCUMENTS

CN 1876945 A 12/2006
CN 1952249 A 4/2007
(Continued)

OTHER PUBLICATIONS

International Search Report and Written Opinion for PCT/US2010/048250 dated Feb. 7, 2011.

*Primary Examiner* — Kristina Fulton
*Assistant Examiner* — Christine M Mills
(74) *Attorney, Agent, or Firm* — Boyle Fredrickson, S.C.

(57) ABSTRACT

A locking latch for an appliance provides an improved three-wire interface that reduces the chance of malfunction if the door is forcibly opened when it is in the lock state and a bi-stabile actuator is used. In one embodiment, the door switch is positioned to disengage the major load of the washing machine when the doors open, regardless of the lock or unlock state.

18 Claims, 5 Drawing Sheets

(51) Int. Cl.
*E05B 47/00* (2006.01)
*D06F 37/42* (2006.01)

(56) References Cited

U.S. PATENT DOCUMENTS

| | | | | | |
|---|---|---|---|---|---|
| 3,857,002 | A | * | 12/1974 | Lay et al. | 200/61.64 |
| 4,074,545 | A | * | 2/1978 | Case | 68/12.26 |
| 4,179,907 | A | * | 12/1979 | Schantz | 68/12.26 |
| 4,718,705 | A | * | 1/1988 | Case | 292/201 |
| 4,995,650 | A | * | 2/1991 | Schantz et al. | 292/201 |
| 5,050,407 | A | * | 9/1991 | Wild | 68/12.06 |
| 5,323,628 | A | * | 6/1994 | Mori et al. | 68/12.26 |
| 5,520,424 | A | * | 5/1996 | Hapke et al. | 292/198 |
| 5,682,772 | A | * | 11/1997 | Hapke et al. | 68/12.26 |
| 5,690,206 | A | * | 11/1997 | Carroll et al. | 192/136 |
| 5,823,017 | A | * | 10/1998 | Hapke et al. | 68/12.26 |
| 6,363,755 | B1 | * | 4/2002 | Hapke et al. | 68/12.26 |
| 7,306,266 | B2 | * | 12/2007 | Hapke et al. | 292/218 |
| 7,420,345 | B2 | | 9/2008 | Menniger | |
| 2002/0113701 | A1 | * | 8/2002 | Turk | 340/542 |
| 2005/0194795 | A1 | | 9/2005 | Hapke et al. | |
| 2007/0108777 | A1 | * | 5/2007 | Mueller et al. | 292/251.5 |
| 2008/0106105 | A1 | * | 5/2008 | Spiessl | A47L 15/4259 292/210 |
| 2010/0052338 | A1 | | 3/2010 | Osvatic et al. | |

FOREIGN PATENT DOCUMENTS

| | | | |
|---|---|---|---|
| DE | 10058312 | A1 | 7/2001 |
| DE | 102007031882 | A1 | 4/2009 |
| GB | 747160 | A | 3/1956 |

* cited by examiner

APPLIANCE LOCK WITH MECHANICAL DOOR SENSOR

CROSS-REFERENCE TO RELATED APPLICATION

The present application is a National Phase of International Application Number PCT/US2010/048250 filed Sep. 9, 2010, and claims the benefits of United States Provisional Application Serial No. 61/241,285, filed Sep. 10, 2009.

FIELD OF THE INVENTION

The present invention relates to clothes washing machines and the like and specifically to a lock assembly for preventing access to the spin basket of such a washer during the spin cycle.

BACKGROUND OF THE INVENTION

During the spin cycle of a washing machine, water is removed from wet clothes centrifugally by spinning the clothes at high speed in a spin basket. In order to reduce the possibility of injury to the user, the user must be prevented from having access to the spin basket while the spin basket is in motion.

One way of protecting the user from access to the rotating spin basket uses an electrically locking latch for the washing machine lid. The latch holds and locks the lid in a closed position for the duration of the spin cycle and for a period after the spin cycle necessary for the spin basket to coast to a stop. This locking latch may be operated by a thermoelectric element such as a bimetallic strip or wax motor. Preferably, however, a fast acting solenoid may be used for the locking mechanism to permit rapid access to the clothes when the spin basket has stopped. Often, to save electrical power, a solenoid may be a bi-stable solenoid receiving a first pulse of electricity to lock the lid and a second pulse of electricity to unlock the lid.

In order to prevent defeat of the lock, it is known to put a lid switch in series with the bi-stable solenoid to prevent the locking action when the lid is open. This lid switch may be accompanied with a "lock switch" indicating that the bolt of the lock is engaged with a door striker. The lock switch is then placed in series with the washing machine motor to prevent activation of the spin cycle when the lid is not properly locked. Together the lid closure switch and the lid lock switch provide some assurance that the lid is properly closed and locked before power is applied to the washing machine mechanism.

SUMMARY OF THE INVENTION

The present inventors have recognized that in some situations where a lid lock employs a bi-stabile solenoid or similar mechanism and when the lid is forced open, the washing machine may remain activated. This situation will be discussed in more detail below. The present invention provides a system to disable the washing machine motor in such circumstances while still employing a simple three-wire interface.

Specifically, the present invention provides a door lock for a door of an appliance having a housing attachable to the appliance near the door, providing three connection conductors for attaching the door lock to other electrical components of the appliance including a first connection conductor connected to an appliance motor and a second connection conductor connected to a power source. The housing holds a door position detector positioned to respond to the closure of the door when the housing is mounted to the appliance, a bi-stable electrical actuator for actuating a door locking element of a latch retaining the door when the housing is mounted to the appliance, and a lock sensing switch which responds to a positioning of the door locking element, the lock sensing switch connected to the first connection conductor. The door position element blocks power to the motive element of the appliance through the first connection conductor when the door is open.

It is thus a feature of at least one embodiment of the invention to provide a lock system that may use a bi-stable actuator and still disable the appliance if the door is forcibly opened. Because the door position element blocks power to the motive element of the appliance regardless of the state of the bi-stable actuator, the problem of the bi-stable actuator being disconnected when the door is opened (and thus being unable to affect the lock sensing switch) is avoided.

The lock sensing switch may be connected between the first connection conductor and a common point. The door position detector is a switch open when the door is open and connected between the second connection conductor and the common point and the bi-stable electrical actuator is connected between a third connection conductor and the common point.

It is thus a feature of at least one embodiment of the invention to provide direct electrical control of the appliance by the door position detector regardless of the state of the bi-stabile actuator and the lock sensing switch.

Power may flow through the motive element by passing through the first and second connection conductors.

It is thus a feature of at least one embodiment of the invention to provide a system compatible with a cost-effective three-wire interface.

The appliance may be a washing machine and the motor may drive rotation of a spin basket of the washing machine accessible through the door.

It is thus a feature of at least one embodiment of the invention to provide an enhanced resistance to vandalism that might compromise the safety of high-speed spin cycle washing machines.

In one embodiment, the lock sensing switch may be connected between the first connection conductor and a common point, the second connection conductor may connect to the common point and the bi-stable electrical actuator may be connected between a third connection conductor and the common point, and the door position detector may be a mechanical element preventing closure of the lock sensing switch when the door is open.

It is thus a feature of at least one embodiment of the invention to provide the benefits of enhanced resistance to forcible opening of the appliance door with a single electrical switch.

The lock sensing switch may communicate with the bi-stable electrical actuator by means of a mechanical operator and wherein the door position detector, when the door is open, blocks movement of the mechanical operator directed to close the lock sensing switch.

It is thus a feature of at least one embodiment of the invention to provide a simple mechanism for mechanical interlock of the door sensor and lock switch.

The door position detector and the mechanical operator may communicate by means of a cam surface and cam follower wherein motion of the door position along a first axis may control motion of the mechanical operator along a second perpendicular axis.

It is thus a feature of at least one embodiment of the invention to provide a compact mechanical apparatus that may sense both door movement and lock movement when these two movements are not aligned.

The bi-stable electrical actuator moves between a first and second state with successive electrical pulses and remains in either the first or second state when power is not applied, and wherein the door is locked in the first state.

It is thus a feature of a least one embodiment of the invention to provide a system that may use energy-efficient bi-stabile actuators that will hold a lock or unlock position without the application of electrical power.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

Figure 1:
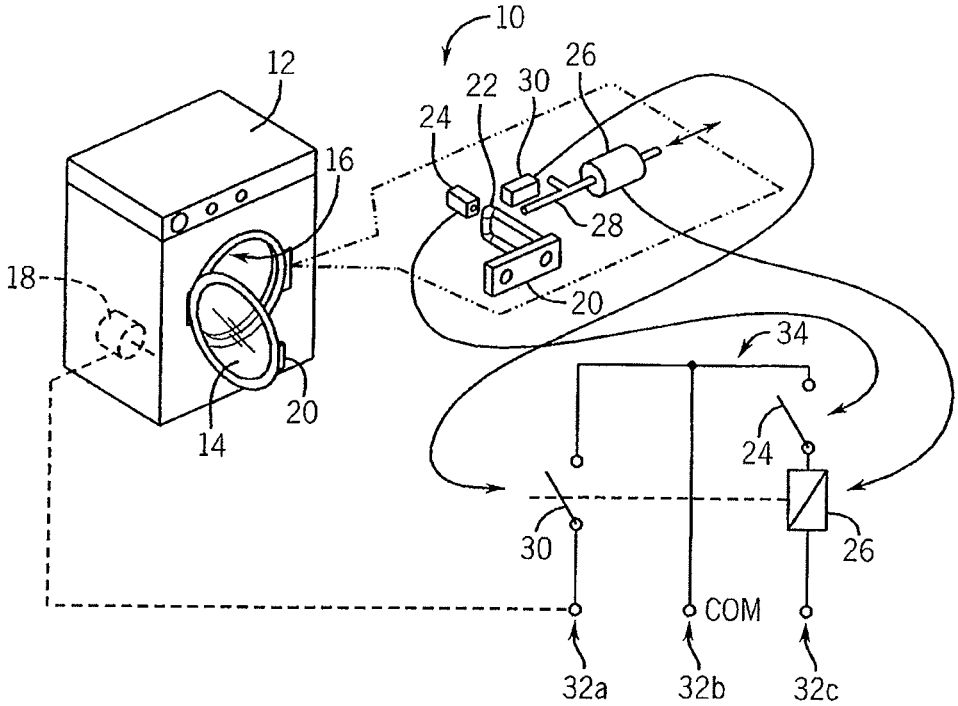
FIG. 1 PRIOR ART
FIG. 1 is a simplified diagram of a prior art locking latch for a front loading washing machine or the like showing an interconnection of a lid position sensor, lock switch and electrical actuator moving a bolt to engage with a striker on the lid.

Referring now to FIG. 1, a prior art locking latch 10 may work with an appliance 12 such as a front loading washing machine having a door 14 that may open and close to selectively expose an internal spin basket 16 operated by a motor 18.

The door 14 may hinge at one edge and at an opposed edge hold a striker 20 having a loop portion 22 that may pass into the housing of the appliance 12 to be received by the locking latch 10 held therein. The loop portion 22 of the striker 20, when the door 14 is closed, may activate a door position detector, being in this case an electrical door switch 24 (for example, a single pole single throw switch) indicating that the door is closed. The door switch 24 in this case will be a normally open switch that is open when the door 14 is open and closed when the door 14 is closed. Other indirect mechanisms for detecting door closure may also be used.

When the door 14 is closed, an electrical signal may be provided to an actuator 26, such as a bi-stable solenoid, to drive a bolt 28 through the loop portion 22 to lock the door 14 against opening. A mechanical element attached to the bolt 28 may also activate a lock switch 30 when the door is so locked. The lock switch 30 is configured to be electrically open when the door 14 is unlocked and electrically closed when the door 14 is locked.

The various elements of the actuator 26, the lock switch 30, and the door switch 24 may be connected in a "three wire" configuration. This three-wire configuration provides three connection conductors 32*a*, 32*b*, and 32*c* joined at a common junction 34. The connection conductors 32 may be leads or terminals of types well known in the art allowing the lock switch 30 to be connected to other components of the appliance 12.

One end of connection conductor 32*a* connects to the lock switch 30 which then connects to the common junction 34. This connection conductor 32*a* provides a connection between the motor 18 and a common voltage point of connection conductor 32*b* when lock switch 30 is closed so that power is applied to the motor 18. Common junction 34 is connected directly to connection conductor 32*b*. The third connection conductor 32*c* connects to the common junction 34 through the series connected combination of the actuator 26 and the door switch 24 so that the actuator 26 may receive power as connected to the common voltage point of connection conductor 32*b* only when the door switch 24 is closed and the appropriate pulses are applied to connection conductor 32*c*.

It will be understood in this context, that the common voltage point of connection conductor 32*b* does not denote a particular polarity (for example line or ground) but is simply a connection that completes a power circuit. This three-wire circuit is described generally in US patent application 2008/0106105 filed Nov. 30, 2005 and hereby incorporated by reference.

As will be appreciated from this description, with this connection of the elements, the lock switch 30 cannot be closed by the actuator 26 unless the door switch 24 is closed and thus the door 14 is closed. This keeps the bolt 28 from engaging when the door 14 is open. Note, however, that if the door 14 is forcibly opened while the bolt 28 is in the lock state, for example, by breaking the end of bolt 28 or the loop portion 22 (without proper retraction of the bolt 28), the motor 18 may continue to operate exposing the user to the rotating spin basket 16 despite the opening of the door switch 24. This is because the actuator 26 is bi-stable and therefore opening of the door switch 24 to remove power from the actuator 26 does not retract the actuator 26. Further, in this case, the door switch 24 would open preventing the actuator 26 from receiving a disengaging pulse such as would retract the bolt 28 and release the lock switch 30 to turn off the motor 18. That is, monitoring of the functional door switch 24 to send signals to open the lock switch 30 to turn off the motor would be of no avail.

Figure 2:
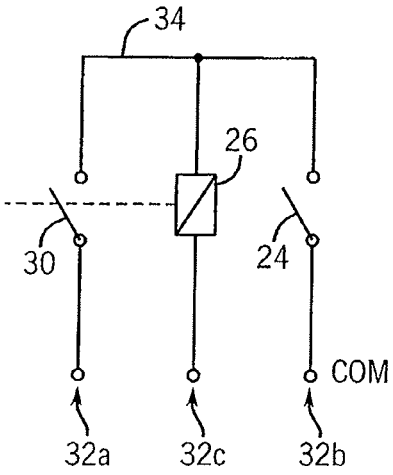
FIG. 2 is a schematic representation of an alternative interconnection of the components of FIG. 1 in a first embodiment according to the present invention in which the lid sensor is a switch placed in series with connection of the lock switch with respect to power flow to the motor.

Referring now to FIG. 2, the present invention modifies the circuit of FIG. 1, in a first embodiment, by relocating the door switch 24 to the branch of the circuit from the common junction 34 to the connection conductor 32*b* so that connection conductor 32*c* contains only the actuator 26. As before, connection conductor 32*b* connects to the common voltage point and connection conductor 32*a* connects through the lock switch 30 to the common junction 34. This configuration allows the door switch 24 to control current flowing in both of connection conductors 32*c* and 32*a* so that when the door 14 opens, in the scenario described above, power will be interrupted at the motor 18 through the agency of the opening of the door switch 24. This approach requires that the current carrying capacity of the door switch 24 be sufficient to interrupt the current required by the motor 18.

Figure 3:
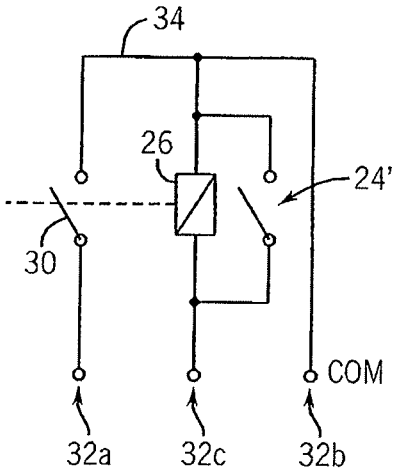
FIG. 3 is a figure similar to that of FIG. 2 of an alternative embodiment in which the actuator and lid switch are placed in parallel.

Referring now to FIG. 3, in an alternative embodiment, the door switch 24' is moved from being in series with the actuator 26 on a branch of the circuit leading to connection conductors 32*c*, per FIG. 1, to being in parallel with actuator 26 on a branch extending between the common junction 34 and connection conductors 32*c*. In addition, the door switch 24' is changed to be a normally closed switch that is closed when the door 14 is open and open when the door 14 is closed. Connection conductor 32*b* connects directly to the common junction 34 and connection conductor 32*a* connects through lock switch 30 to the common junction 34. It will be understood, then, that when the door 14 is open, door switch 24' shorts the actuator 26 preventing it from being actuated. Nevertheless, this configuration allows an appliance controller (for example a microcontroller, not shown) to monitor whether the door is opened or closed at all times by monitoring the impedance between connection conductor 32*c* and connection conductor 32*b*. A high impedance means that the door 14 is closed while a low impedance means that the door 14 is opened. The appliance controller may then break the power to connection conductor 32*c* to open lock switch 30 and thus to cut power to the motor 18.

Figure 4:
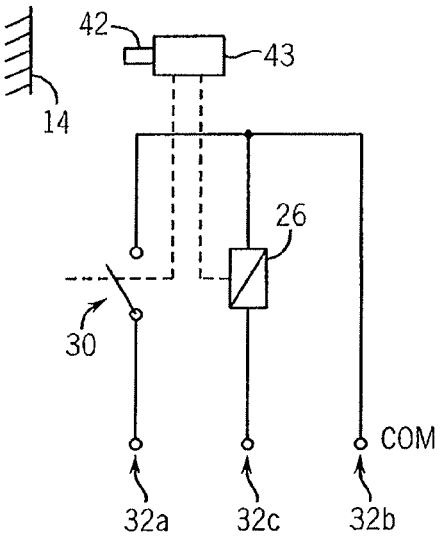
FIG. 4 is a figure similar to that of FIGS. 2 and 3 eliminating the lid switch and using instead a mechanical intermediary between the actuator and the lock switch.

Referring now to FIG. 4, in a third alternative embodiment, the door switch 24 is eliminated and the actuator 26 is allowed to control the lock switch 30 only through mechanical intermediary 43 having operator 42 mechanically moving by the closure of the door 14, the mechanical intermediary 43 operating so that the actuator 26 may close the lock switch 30 only when the door 14 is closed. The operator 42 thus provides a door position detector in a mechanical form. The mechanical operator 42 may be spring biased outward by a spring (omitted for clarity) to be pushed against the biasing by the closing door 14.

Figure 5:
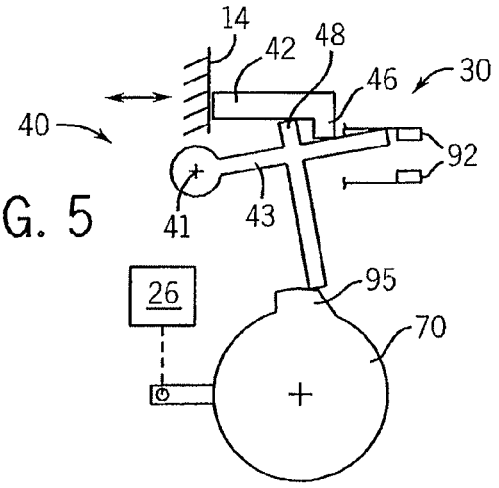
FIG. 5 is a simplified schematic diagram showing the principle of operation of the mechanical intermediary, with portions of the mechanical intermediary rotated into the plane of the figure for clarity and showing the latch in a first state with the door closed but unlocked.

Referring now to FIG. 5, the operation of a mechanical intermediary 43 of FIG. 4 may be understood by a simplified diagram in which the operator 42 moves rightward (as depicted) when the door 14 is closed and leftward when the door 14 is open. In this example, the actuator 26 may rotate a stop support 70 from the position shown in FIG. 5 to a counterclockwise position shown in FIGS. 6 and 7 to effect a locking of the latch. Structure suitable for this purpose is described below and in detail in a pending US application 2010/0052338 entitled "Gasket-Compensating Latch Mechanism" and the pending US application 20050194795 entitled: "Appliance Latch Having a Rotating Latch Hook Mounted on a Linear Slide", the specifications of which are hereby incorporated in their entirety by reference.

When the stop support 70 is in its unlock position as shown in FIG. 5 and the door 14 is closed, as depicted, contacting the operator 42, a cam surface 95 on the stop support 70 presses upward on the blocking lever assembly providing the mechanical intermediary 43 causing a free end of the lever assembly to hold electrical contacts 92 apart, the electrical contacts providing the lock switch 30. As depicted, the upper contact 92 contacting the lever of mechanical intermediary 43 is movable on a leaf spring which presses downward on the mechanical intermediary 43 and the lower contact 92 is fixed.

Figure 6:
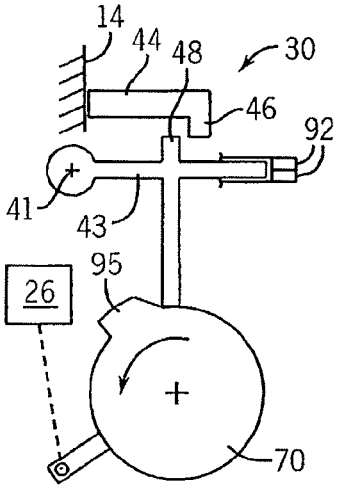
FIG. 6 is a figure similar to that of FIG. 5 showing a second state with the door closed and the actuator activated to lock the door.

As shown in FIG. 6, when the bi-stable actuator 26 causes counterclockwise rotation of the stop support 70 to lock the latch, the cam surface 95 is moved away from engagement with the lever assembly of the mechanical intermediary 43 allowing the latter to drop in a clockwise rotation about pivot point 41 so that the free end of the lever of the mechanical intermediary 43 no longer separates contacts 92 permitting closure of the lock switch 30.

Figure 7:
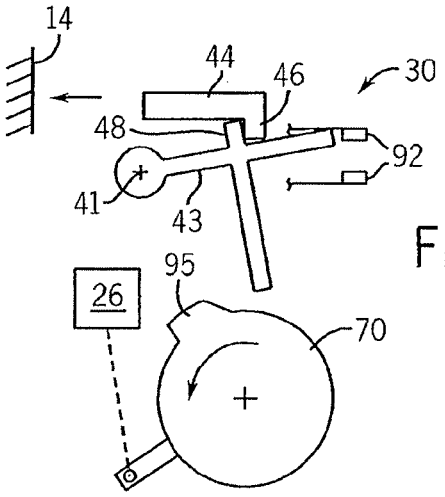
FIG. 7 is a figure similar to that of FIGS. 5 and 6 in a third state with the actuator activated to lock the door while the door is open.

As shown in FIG. 7, if the door 14 is open however, moving the door 14 away from the operator, the operator 42 moves leftward (under the influence of a spring not shown) and an engaging surface 46 of the operator 42 contacts a corresponding engaging surface 48 on the lever of mechanical intermediary 43 to prevent rotation of the lever of mechanical intermediary 43 in a clockwise direction so that its free end may not move downward to allow closure of the contacts 92 regardless of position of the stop support 70. Thus, the actuator 26 may only close the contacts 92 when the door 14 is closed.

Figure 8:
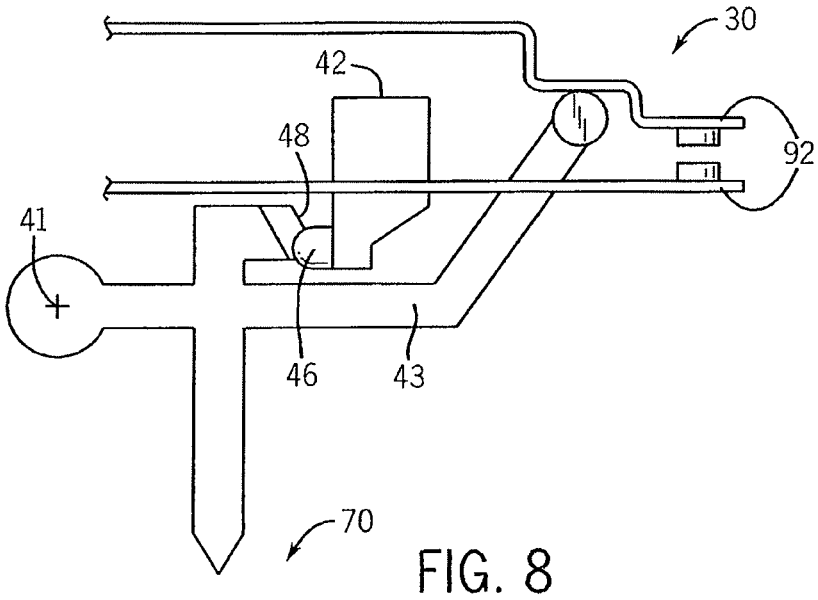
FIG. 8 is a front elevational view of an implementation of the latch of the present invention shown in a state with the door open corresponding generally to FIG. 7.
Figure 9:
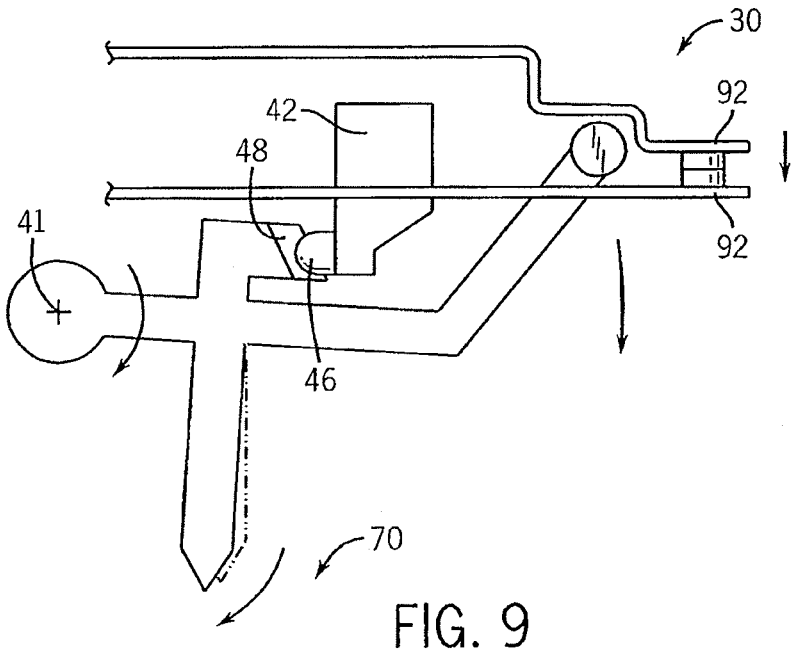
FIG. 9 is a figure similar to that of FIG. 8 showing a state when the door is in the closed position and the actuator activated to lock the door corresponding generally to FIG. 6.

Referring now to FIGS. 8 and 9, for reasons of mechanical compactness, in one embodiment of the invention, the operator 42 may be rotated 90° to move linearly not left and right as depicted in FIGS. 5-7 but in and out of the plane of the paper in FIGS. 8 and 9. In order to provide for the necessary mechanical interaction, the engaging surface 48 is formed as a ramp having a radial component about pivot point 41 which may be engaged to cause a counterclockwise rotation of the mechanical intermediary 43 about pivot point 41 when the engaging surface 46 moves downward (into the plane of the paper) as shown in FIG. 8 when the door 14 is open, separating contacts 92. Conversely, when the door 14 is closed, engaging surface 46 may move upward (out of the plane of the paper) as shown in FIG. 9 allowing a clockwise rotation about pivot point 41 and a closure of contacts 92 if cam surface 95 is not engaged.

Figure 10:
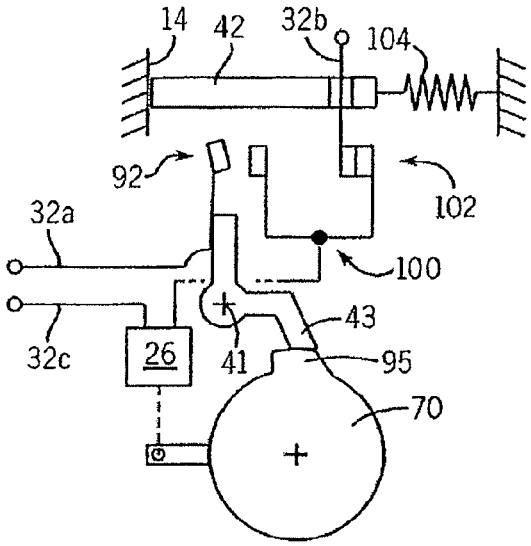
FIG. 10 is a simplified diagram similar to that of FIG. 5 for a second embodiment in which the lid detector is mechanically independent from the lock switch.
Figure 11:
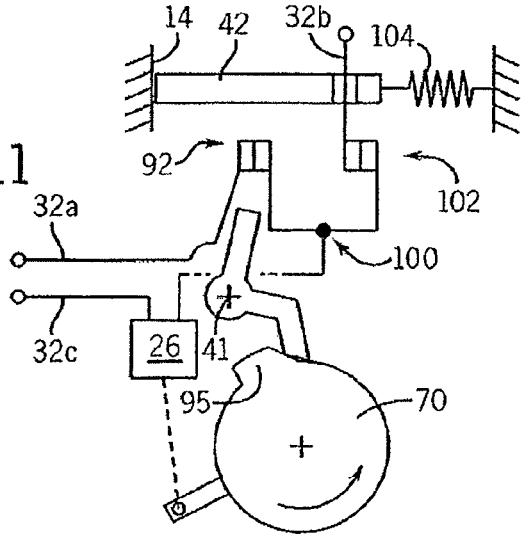
FIG. 11 is a figure similar to that of FIG. 6 for the embodiment of FIG. 10.
Figure 12:
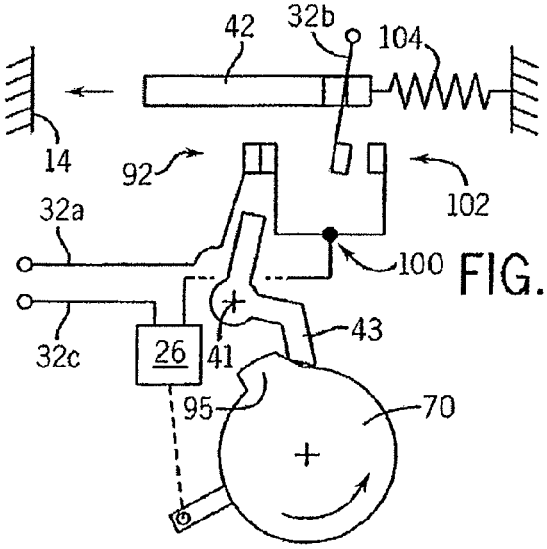
FIG. 12 is a figure similar to that of FIG. 7 for the embodiment of FIG. 10.

Referring now to FIGS. 10-12, in an alternative embodiment, the circuit of FIG. 2 may be implemented by a variation on the configurations of FIGS. 5-7 where the lever of mechanical intermediary 43 no longer mechanically communicates with the operator 42 but operates independently with rotation of the stop support 70 and engagement with cam surface 95 to open contacts 92 (as described above).

The contacts 92 are unaffected by movement of the mechanical operator 42. One side of the contacts 92 may be connected to connection conductor 32*a* and the other side connected to a junction plate 100 (providing a common junction 34 described above) which connects to one lead of actuator 26 whose other lead provides connection conductor 32*c*. When the stop support 70 is in its unlock position, as shown in FIG. 10, the contacts 92 will be open and when the stop support 70 is in its lock position, as shown in FIGS. 11 and 12, the contacts 92 are closed.

Mechanical operator 42 contacts the door 14 to open or close a second set of contacts 102 that are independent of contacts 92. This set of contacts 102 has one contact tied to the junction plate 100 and the other connected to connection conductor 32*b*. As in the embodiment of FIGS. 5-7, the operator 42 may be biased by a spring 104 that tends to push the mechanical operator 42 outward so that closure of the door 14 presses the mechanical operator 42 inward against the biasing of the spring to close the contacts 102. This spring 104 may be implemented by a leaf spring supporting one of the contacts 102. Thus, when the door 14 is closed, as shown in FIGS. 10 and 11, the contacts 102 are closed and when the door is open, the contacts 102 are open.

Figure 13:
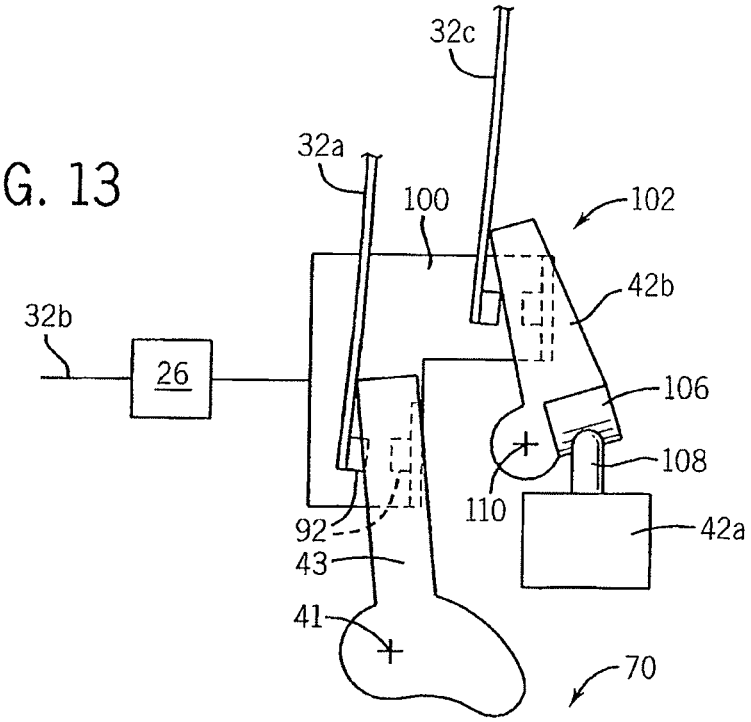
FIG. 13 is a front elevational view similar to that of FIG. 8 for the embodiment of FIG. 10.
Figure 14:
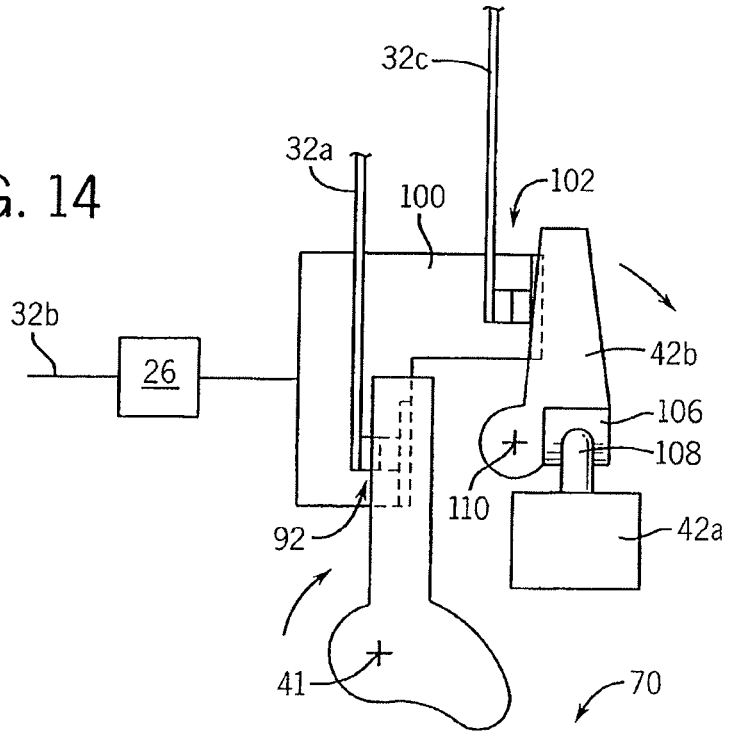
FIG. 14 is a figure similar to that of FIG. 13 similar to that of FIG. 9 for the embodiment of FIG. 10.

Referring now to FIG. 13, the mechanism of FIGS. 10-12 may be implemented, again, for reasons of mechanical compactness, by rotating a portion of operator 42 by ninety degrees to move linearly not left and right as depicted in FIGS. 10-12 but in and out of the plane of the paper of FIGS. 13 and 14. In this case operator 42 is implemented as two components: translating operator 42*a* which moves in and out of the plane of the paper in a manner similar to that described in FIGS. 8 and 9, and pivoting operator 42*b* which moves left and right to activate contacts 102 by separating the leaf springs on which they are supported. This conversion of motion of translating operator 42*a* into and out of the plane of the paper to the left and right motion of pivoting operator 42*b* is accomplished by the cam surface formed between ramp 106 formed on pivoting operator 42*b* and engaging surface 108 attached to translating operator 42*a*. The ramp 106 has a radial component with respect to a center of rotation 110 of the pivoting operator 42*b* so that motion of the engaging surface 108 against the ramp 106 provides a mechanical coupling causing rotational left and right motion of operator 42*b* about center of rotation 110 with in and out motion of operator 42*a*. Thus, as shown in FIG. 13, when the door 14 is open, translating operator 42*a* and engaging surface 108 move downward (into the plane of the paper) pressing against ramp 106 causing a counter-clockwise pivoting of pivoting operator 42*b* about center of rotation 110 to rotate leftward about an axis generally aligned with the linear motion of translating operator 42*a* to open contacts 102. Conversely, as shown in FIG. 14, when the door 14 is closed, when translating operator 42*a* and engaging surface 108 move upward (out of the plane of the paper), they release ramp 106 causing a clockwise pivoting of pivoting operator 42*b* in response to spring forces applied on operator 42*b* by the flexed leaf spring holding a movable one of contacts 102, allowing those contacts 102 to close. In this way the elements of circuit shown in FIG. 2 may be implemented.

In the above described embodiments, the stop support 70 may be a type as described in US patent application 2010/0052338 (the '338 application) cited above, where the stop support 70 (labeled stop support 70 in the '338 application) supports a cam surface 95 (labeled as cam surface 95 in the '338 application) that may be moved by means of an actuator 26 (labeled as solenoid 80 in the '338 application). In this case, the bolt 28 is provided by the intra-engagement of a pair of ramps (labeled as ramps 60 and 68 in the '338 application) which may prevent opening of the latch when the bolt 28 engages the stop support 70 and whose engagement is indicated by the rotated position of stop support 70. The present invention may thus include these elements and the associated elements in these applications that provide for: gasket adjusting features (ramps 60 in the '338 application), bi-stability of a single acting solenoid (cardioids track 104 and associated components in the '338 application), and storage of energy in a spring when the doors opened, that helps close the door when the door is closed (spring 26 in the '338 application). In the mechanism of the cardioids track 104, the steel ball 102 and slot 100 may be replaced by the tip of the spring form wire having its other end attached to the bi-stable mechanism 82.

It will be understood that the present invention is applicable to a variety of different appliance types and that the motor 18 may be represented in such appliances by other electrical or mechanical elements that must be de-energized upon opening of the door for the safety of the user. It will be further understood that the present invention is equally applicable to top-load and front-load type washing machines and that the terms 'lid' and 'door' should be considered interchangeable in this regard.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A door lock for a door of an appliance, comprising:

a housing attachable to the appliance near the door, the housing supporting and exposing only three connection conductors, the three connection conductors for attaching the door lock to other electrical components of the appliance including a first connection conductor connectable to an appliance motor and a second connection conductor connectable to a power source, the housing holding:

a door position detector positioned to respond to a closure of the door when the housing is mounted to the appliance;

a bi-stable electrical actuator for actuating a door locking element of a latch retaining the door when the housing is mounted to the appliance, the bi-stable electrical actuator communicating with the door locking element to both move the door locking element between a first state locking the door locking element and a second state releasing the door locking element in response to current flowing between only two connection conductors; and a lock sensing switch opening in response to a positioning of the door locking element in the second state, the lock sensing switch connected to the first connection conductor; and wherein the door lock, when communicating with the other electrical components of the appliance only through the only three connection conductors, is adapted to:

(i) move the bi-stable electrical actuator between the first state and the second state when the door is closed; and (ii) block power to the appliance motor of the appliance through the first connection conductor whenever the door is open as sensed by the door position detector; and (iii) supply power to the motor appliance motor through the first connection conductor when the door is closed, the supplied power not passing through the bi-stable actuator.

2. The door lock of claim 1 wherein the lock sensing switch is connected between the first connection conductor and a common point of a connection conductor, the door position detector is a switch open when the door is open and connected between the second connection conductor and the common point, and the bi-stable electrical actuator is connected between a third connection conductor and the common point.

3. The door lock of claim 2 wherein power through the appliance motor passes through the first and second connection conductors.

4. The door lock of claim 2 wherein the appliance is a washing machine and the motor drives rotation of a spin basket of the washing machine accessible through the door.

5. The door lock of claim 1 wherein the lock sensing switch is connected between the first connection conductor and a common point, the second connection conductor connects to the common point and the bi-stable electrical actuator is connected between a third connection conductor and the common point; and wherein the door position detector is a mechanical element preventing closure of the lock sensing switch when the door is open.

6. The door lock of claim 5 wherein the lock sensing switch communicates with the bistable electrical actuator by means of a mechanical operator and wherein the door position detector, when the door is open, blocks movement of the mechanical operator directed to close the lock sensing switch.

7. The door lock of claim 6 wherein the door position detector and the mechanical operator communicate by means of a cam surface and cam follower wherein motion of the door position along a first axis may control motion of the mechanical operator along a second perpendicular axis.

8. The door lock of claim 5 wherein power through the appliance motor passes through the first and second connection conductors.

9. The door lock of claim 1 wherein the bi-stable electrical actuator moves between a first and second state with successive electrical pulses and remains in either the first or second state when power is not applied, and wherein the door is locked in the first state.

10. A method of controlling access by a user of an appliance having a door, the method comprising the steps of:

(a) affixing a latch providing only three connection conductors near the door, the three connection conductors supported by the latch and exposed for connection to other electrical components of the appliance, the latch including a door position detector positioned to respond to a closure of the door when the latch is mounted to the appliance, a bi-stable electrical actuator for actuating a door locking element of a latch retaining the door when the latch is mounted to the appliance, the bi-stable electrical actuator communicating with the door locking element to both move the door locking element between a first state locking the door locking element and a second state releasing the door locking element in response to current flows between only two connection conductors, and a lock sensing switch opening in response to a positioning of the door locking element in the second state, wherein the lock sensing switch is connected to a first connection conductor;

(b) attaching the first connection conductor to a primary motive element of the appliance;

(c) attaching a second connection conductor to a power source;

(d) while conununicating with the other electrical components of the appliance only through the only three connection conductors:

(i) move the bi-stable electrical actuator between the first state and the second state when the door is closed; and (ii) block power to the appliance motor of the appliance through the first connection conductor whenever the door is open as sensed by the door position detector; and (iii) supply power to the appliance motor through the first connection conductor when the door is closed, the supplied power not passing through the hi-stable actuator.

11. The method of claim 10 wherein the lock sensing switch is connected between the first connection conductor and a common point, the door position detector is a switch open when the door is open and connected between the second connection conductor and the common point, and the hi-stable electrical actuator is connected between a third connection conductor and the common point.

12. The method of claim 11 wherein power through the motive element passes through the first and second connection conductors.

13. The method of claim 11 wherein the appliance is a washing machine and the motive element is a motor that drives rotation of a spin basket of the washing machine accessible through the door.

14. The method of claim 10 wherein the lock sensing switch is connected between the first connection conductor and a common point, the second connection conductor connects to the common point and the hi-stable electrical actuator is connected between a third connection conductor and the common point; and wherein the door position detector is a mechanical element preventing closure of the lock sensing switch when the door is open.

15. The method of claim 14 wherein the lock sensing switch communicates with the hi-stable electrical actuator by means of a mechanical operator and wherein the door position detector, when the door is open, blocks movement of the mechanical operator directed to close the lock sensing switch.

16. The method of claim 15 wherein the door position detector and the mechanical operator communicate by means of a cam surface and cam follower wherein motion of the door position along a first axis may control motion of the mechanical operator along a second perpendicular axis.

17. The method of claim 14 wherein power through the motive element passes through the first and second connection conductors.

18. The method of claim 10 wherein the hi-stable electrical actuator moves between a first and second state with successive electrical pulses and remains in either the first or second state when power is not applied, and wherein the door is locked in the first state.

* * * * *